US005782935A

United States Patent [19]

Hirt et al.

[11] Patent Number: 5,782,935

[45] Date of Patent: Jul. 21, 1998

[54] PROCESS FOR COLORING POLYTRIMETHYLENE TEREPHTHALATE FIBRES AND USE OF THE FIBRES COLORED BY THIS PROCESS

[75] Inventors: Peter Hirt, Schorndorf; Gilbert Kühl, Hanau, both of Germany; Hermann Piana, White Plains, N.Y.; Hansjörg Traub, Aalen; Heinz Herlinger, Seckach, both of Germany

[73] Assignee: Degussa Aktiengesellschaft, Frankfurt, Germany

[21] Appl. No.: 696,995

[22] PCT Filed: Feb. 9, 1995

[86] PCT No.: PCT/EP95/00455

§ 371 Date: Dec. 12, 1996

§ 102(e) Date: Dec. 12, 1996

[87] PCT Pub. No.: WO95/22650

PCT Pub. Date: Aug. 24, 1995

[30] Foreign Application Priority Data

Feb. 21, 1994 [DE] Germany ..... 44 05 407.6

[51] Int. Cl.[6] ..... D06P 3/54

[52] U.S. Cl. ..... 8/512; 8/922

[58] Field of Search ..... 8/512, 922

[56] References Cited

U.S. PATENT DOCUMENTS 3,841,831 10/1974 Miller ..... 8/922 X

*Primary Examiner*—Margaret Einsmann

*Attorney, Agent, or Firm*—Cushman Darby & Cushman IP Group of Pillsbury Madison & Sutro LLP

[57] ABSTRACT

The present invention relates to a process for coloring polytrimethylene terephthalate fibers by treating the fibers with an aqueous liquor containing at least one dispersing colorant, in the absence of a carrier and the application of pressure. The temperature of the treatment is carried out at or below the boiling point of the liquid, within 20° C. of the boiling point of the liquor. The coloring process begins at a liquor temperature between 20° and 50° C., and the temperature is raised over a period of 20 to 90 minutes. The liquor is then cooled to a temperature between 20° and 50° C., preferably at a rate of cooling of 1° C. per minute, so that at least 95% wt. % of the colorant is absorbed by the fibers, and the dispersing colorant penetrates the fibers to a relative depth of at least 5% with respect to the diameter of the fibers.

19 Claims, 7 Drawing Sheets

C. I. Disperse Blue 139

C. I. Disperse Red 60

PROCESS FOR COLORING POLYTRIMETHYLENE TEREPHTHALATE FIBRES AND USE OF THE FIBRES COLORED BY THIS PROCESS

BACKGROUND OF THE INVENTION

The invention relates to a process for colouring polytrimethylene terephthalate fibrrs using disperse colorants in aqueous liquors at or below the boiling point of the liquor and use of the fibres coloured according to the invention.

BACKGROUND

Polytrimethylene terephthalate (PTMT) is a polyester which has 1,3-propanediol as the diol component and terephthalic acid as the dicarboxylic acid component. Large-scale synthesis of polyesters may basically be performed by two different methods (H-D. Schumann in Chemiefasern/Textilind. 40/92 (1990), p. 1058 et seq.).

On the one hand, the older process, which was exclusively used up to about 1960, involving transesterification of dimethyl terephthalate with a diol to give bis-hydroxyalkyl terephthalate and subsequent polycondensation. On the other hand, the method extensively used today, involving direct esterification of terephthalic acid with a diol and subsequent polycondensation.

During transesterification, dimethyl terephthalate is transesterified with 1,3-propanediol using catalysts at temperatures of 160°–210° C. and the methanol being released is distilled out of the reaction mixture at atmospheric pressure. The reaction mixture, which comprises mostly bis-(3-hydroxypropyl) terepthalate, is further heated to 250°–280° C. under reduced pressure and the 1,3-propanediol being released is removed. Formation of polytrimethylene terephthalate from bis-(3-hydroxylpropyl) terephthalate may be catalysed by the same catalyst as used for transesterification or, after deactivation of the same, a different polycondensation catalyst may be added.

Reaction scheme

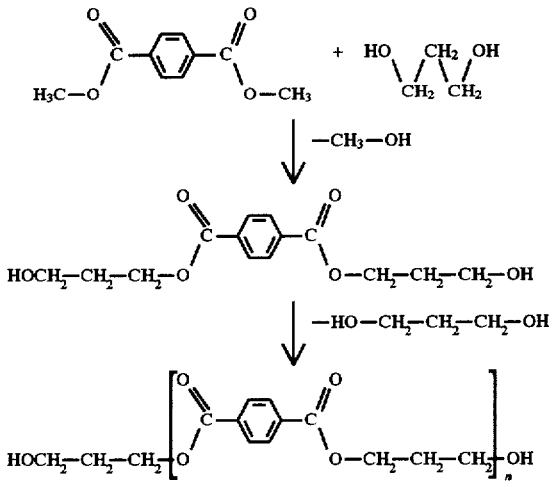

The preparation of polytrimethylene terephthalate has already been described in GB 578079. Transesterification of dimethyl terephthalate with 1,3-propanediol is catalysed by sodium and magnesium. The alcohols released are distilled off at atmospheric pressure and the reaction mixture is further heated under reduced pressure until polymeric polytrimethylene terephthalate is obtained.

A compound fibre made from polyethylene terephthalate and polytrimethylene terephthalate is described in GB 1075689. When preparing the polytrimethylene terephthalate, dimethyl terephthalate and 1,3-propane diol are used as starting materials and titanium tetrabutylate is used as transesterification and polycondensation catalyst.

Two catalyst systems for preparing polytrimethylene terephthalate are known from FR 2038039. In both cases, dimethyl terephthalate and 1,3-propanediol are used as starting materials. On the one hand, $NaH[Ti(OBu)_6]$ is used as transesterification and polycondensation catalyst and in the other process "Tyzor TBT" from Du Pont and $MgCO_3$ are used as transesterification catalysts and an antimony compound is used as the polycondensation catalyst.

German document OS 19 54 527 relating to catalysts for preparing polyesters, describes another possibility for catalysis during the production of polytrimethylene terephthalate. Here again, dimethyl terephthalate and 1,3-propanediol are used as starting materials.

Manganese(II) acetate tetrahydrate is used as the transesterification catalyst and hexagonal crystalline germanium dioxide with a particle size of less than 2 μm is used as the polycondensation catalyst. These catalysts may also be used for producing dipolymers from terephthalic acid, 1,2-ethanediol and 1,3-propanediol.

A further catalyst mixture which is not based on titanium is described in U.S. Pat. No. 4,167,541. In this case cobalt acetate and zinc acetate are described as catalysts for the transesterification of dimethyl terephthalate using 1,3-propanediol and antimony oxide is used as the catalyst for polycondensation.

A new type of catalyst system is described in U.S. Pat. No. 4,611,049 and DE-OS 34 22 733. Again starting from dimethyl terephthalate and 1,3-propanediol, titanium tetrabutylate is added as catalyst. In addition, p-toluenesulphonic acid is added as promoter, thus achieving a higher molecular weight.

In 1988, C. C. González, J. M. Pereña and A. Bello (J. Polym. Sci., Part B: Polymer Physics 26 (1988), 1397) prepared linear polyesters starting from dimethyl terephthalate, 1,3-propanediol and ditrimethylene glycol. Tetraisopropyl titanate is used as transesterification and polycondensation catalyst. Copolymers of terephthalic acid, 1,3-propanediol and ditrimethylene glycol can also be prepared using this same catalyst.

Various further catalyst systems have been described only recently, in EP 0 547 553. Starting from dimethyl terephthalate and 1,3-propanediol, titanium tetrabutylate, sodium and titanium tetrabutylate, zinc acetate, cobalt acetate and titanium tetrabutylate, as well as butylhydroxytin oxide have been described as transesterification catalysts. The polycondensation catalysts used are titanium tetrabutylate, antimony trioxide, butylhydroxytin oxide and a combination of antimony trioxide and butylhydroxytin oxide.

This also gives, for the first time, a synthesis pathway for direct esterification. Starting from terephthalic acid and 1,3-propanediol, esterification is performed thermally under pressure and the subsequent polycondensation is catalysed by antimony trioxide.

All the publications listed above described different ways for making PTMT or fibres therefrom. None of the publications, however, disclose any technical details relating to colouring PTMT fibres.

With regard to other polyester fibres, e.g. polyethylene terephthalate fibres, there is already a whole set of investigations regarding their colouring behaviour. Thus, it is known (Herlinger, Gutmann and Jiang in CTI, Chemiefasern/Textilindustrie 37/89, February 1987, p. 144–150), that the use of polyethylene terephthalate in the textile sector is always associated with certain problems with respect to colouring.

SUMMARY OF THE INVENTION

Basically polyesters can only be optimally coloured with disperse colorants using carriers under so-called HT conditions, i.e. at elevated temperature, eg. 130° C., in pressurised vessels (Béla v. Falkai in "Synthesefasern", Verlag Chemie, Weinheim, 1981, p. 176). Carriers are special auxiliary agents which have to be added to the colorant liquors in order first of all to enable absorption of the colorant in practice. Examples of carriers, which may also be called fibre swelling agents, are, inter alia, o-hydroxybiphenyl or trichlorobenzene. It is assumed that this type of auxiliary agent lowers the freezing temperature above which the large molecular segments of the fibres in the non-crystalline areas become mobile, which accelerates the colouring process.

The necessity for removing the carrier from the fibre after the colouring procedure, in order to avoid it having an unfavourable effect on the serviceability of the fibres, concern about environmental protection (pollution of effluents and the air by carriers) and problems with colouring polyester/wool mixtures (wool cannot be coloured in a HT process) led to the development of polyester fibres which can be coloured at boiling point without the use of a carrier.

In order to produce polyesters which can be coloured without a carrier at boiling point and without applying a pressure, it is known that the polyester can be chemically or physically modified (Herlinger et al. in: Chemiefaser/Textilindustrie CTI 37/89, p. 144–150, in Chemiefaser/Textilindustrie CTI 37/89, p. 806–814 and in Chemiefaser/Textilindustrie CTI 40/92, Feb. 1990).

In the case of chemical modification, for example, ether-modified polyethylene terephthalate was prepared. Thus, during the production of polyethylene terephthalate polymer (PETP), polyether blocks, consisting of polyethylene glycol (PEG) units were incorporated into the PETP chains, these facilitating the absorption of colorants due to their mobility. Similarly, it was attempted to incorporate by polymerisation into the polyethylene terephthalate, polybutylene glycol units instead of the PEG units. A lowering of the glass transition temperature is also noted with this type of polyester and the colouring behaviour is definitely improved.

Furthermore, it is known that copolyesters of polyethylene terephthalate and polybutylene terephthalate may be prepared to improve the colouring properties, but these do not have sufficient thermal stability, so they cannot be considered as an alternative, like pure polybutylene terephthalate, which basically can also be coloured without using a carrier but has too low a melting point, which does not permit application of the elevated temperatures required for the finishing steps.

In contrast good thermal stability is exhibited by physically modified types of polyethylene terephthalate which have been produced by the coextrusion of mechanical mixtures of polyethylene terephthalate and polybutylene terephthalate granules.

It is known, from DE 36 43 752 A1, that fibres of polybutylene terephthalate can be coloured with disperse colorants in aqueous liquors without the use of carriers and without the application of pressure.

It is known from Ullmann, 4th ed., vol. 22, p. 678 (1983) that in the case of PET very pale shades of colours may sometimes be produced, by colouring without the use of carriers or of pressure. The type of disperse colorants which are suitable for this are those which can diffuse rapidly enough into the PET fibres at 100° C., e.g. C. I. disperse red 60. Using this procedure, however, as already mentioned above, at the very best weak annular colouring of the fibre surface is produced, wherein generally only an extremely small proportion of the colour present in the liquor is absorbed. The results in every case are pale shades of colour with a low colour intensity. This is true in general terms for all disperse colorants, even for those which have a high coefficient of diffusion.

Finally, U.S. Pat. No. 3,841,831 discloses a colouring process for polyester fibres in which the colouring is performed without a carrier and without pressure, using disperse colorants in an aqueous bath at 25° to 100° C. This general statement, however, is severely restricted in the description of U.S. Pat. No. 3,841,831, in fact on the one hand to PET fibres and on the other hand to extremely small amounts of colorant in the colouring bath. In addition, the cited colouring process always includes an additional fixing step in order to facilitate somewhat deeper penetration of the colorant into the fibres. All this supports the fact that when using PET in the textile sector, optimal colouring without the use of a carrier or of pressure, has hitherto not been possible.

Basically it should be noted that most of the polyester products hitherto disclosed which can be coloured without the use of a carrier, at boiling point and without the application of pressure, barely correspond to the picture which the consumer associates with known polyester fibres. In some the initial modulus of elasticity is reduced (they feel limp), there is a greater tendency to crease, the resistance to washing suffers, the ability to recover their shape decreases or the tendency to pill increases.

In view of the prior art described above, the object of the invention was to provide a process for colouring polytrimethylene terephthalate fibres which could be used for environmentally friendly permanent colouring of polytrimethylene terephthalate fibres and in addition which leads to coloured polyester fibres which have outstanding processing properties and which also satisfy the current demands placed on polyester fibres from a thermal and mechanical point of view. In particular, the colour in the coloured fibres should have increased wear-resistance when the fibres and textile products produced therefrom are used, in cases where the wear is due to repeated abrasion at the fibre surface.

This, and other objects which are not stated in detail, is achieved by a process with the features in the description below.

When polytrimethylene terephthalate fibres (PTMT fibres) are treated with an aqueous liquor which contains at least one disperse colorant, wherein the temperature is at or below the boiling point of the liquor, no carrier is added and pressure is not applied, wherein at the same time the colouring process is started at a liquor temperature between 20° and 50° C., the temperature is raised over 20–90 minutes, preferably over 45 minutes, to the boiling point of the liquor or to a colouring temperature which is a maximum of 20° C. below the boiling point of the liquor, colouring is continued for at least 20 minutes, preferably 30–90 minutes, at the colouring temperature or boiling point and then the liquor is cooled to a temperature of 20°–50° C., preferably at a rate of cooling of 1° C. per minute, so that at least 95 wt. % of the colorant present in the liquor is absorbed by the PTMT fibres, and the disperse colorant penetrates the fibres to a relative depth of at least 5% with respect to the diameter of the fibres being coloured, this enables environmentally friendly colouring of the PTMT fibres and the production of coloured PTMT fibres with outstanding colorant properties and with exceptional mechanical and thermal properties, which can be further processed very advantageously to produce woven and knitted fabrics of all types.

Within the context of the invention, it has been demonstrated that basically all known polytrimethylene terephthalate fibres can be coloured with disperse colorants without using a carrier. In particular, this also includes the fibres obtainable in accordance with the process disclosed in EP 0 547 533.

This was rather surprising because, starting from the experiences available with regard to polyethylene terephthalate, the favourable colouring behaviour of polytrimethylene terephthalate would not have been expected.

Even if account is taken of the fact that it is known that polyesters of pure polybutylene glycol terephthalate can be coloured without the use of carriers, this could not be assumed from the outset to be the case for fibres made from polytrimethylene terephthalate. Apart from the colouring properties, there are also, inter alia, thermal properties of the polyester which have to be considered in relation to serviceability. In the case of a polymer which is suitable as a raw material for fibres for textile purposes, the melting point of the basic ester should be well above 200° C. The melting points of esters from diols with an odd number of methylene groups in the diol, however, are generally below the melting points of the esters with the next highest even number of methylene groups in the diol. This effect, however, is only clearly demonstrated with higher numbers of methylene groups. In the case of polytrimethylene and polybutylene terephthalate, the melting points are almost identical.

Also, with respect to the glass transition temperature, which should be as low as possible for good colouring properties at boiling point without adding a carrier, the prior art did not give a clear pointer to the suitability of polytrimethylene terephthalate for being coloured without the use of a carrier. The information provided by various authors differs greatly. G. Farrow et al. in Makromol. Chem. 38 (1960) p. 147 established the glass transition temperature at 95° C., and thus above that of polybutylene terephthalate, whereas a glass transition temperature of 45° C. is cited for polytrimethylene terephthalate in U.S. Pat. No. 3,681,188. Jackson et al. in J. Appl. Polym. Sci. 14 (1970), p. 685, also publish a glass transition temperature for polytrimethylene terephthalate which is above that of polybutylene terephthalate. All in all, therefore, starting from the existing physical data with regard to colouring behaviour, no unambiguous conclusion can be drawn from the outset as to the similarity to polybutylene terephthalate or to polyethylene terephthalate.

According to the invention, polytrimethylene terephthalate fibres are particularly preferably coloured which are obtainable from polytrimethylene terephthalate which has been produced by using a single catalyst, preferably a titanium compound, for transesterification and for subsequent polycondensation. In this case, it is of particular advantage that the transesterification catalyst is not converted into an inactive form prior to polycondensation. Furthermore, the catalytically active species in many cases is produced only in the reaction mixture and it can remain in the polymer until reaction has terminated.

Fibres for the invention made of the PTMT material obtained can be produced by any method commonly used by a person skilled in the art. The polytrimethylene terephthalate is preferably subjected to a melt spinning process to produce the fibres, wherein the polymer material is first dried to a water content of less than 0.02 wt. %, preferably at temperatures of about 165° C. The polyester spun fibres obtained may, if so desired, be hot stretched at temperatures of 110° C. (hot pin) or 90° C. (heating block) before being coloured, using a stretching system known to a person skilled in the art.

The disperse colorants (disperse dyes) which can be used in the process according to the invention are not restricted to specific compounds but rather include all colorants with low solubility in water which are capable of colouring hydrophobic fibres from an aqueous dispersion. Suitable disperse colorants are familiar to a person skilled in the art and examples which may be mentioned are colorant classes from the azo series, aminoanthraquinones or aminohydroxyanthaquinones or nitro colorants. Included among these are monoazo colorants which have several nitro or cyano substituents and heterocyclic azo and polymethine colorants. Members of these colorant classes may be used singly or in mixtures of several together, wherein members of different classes may be mixed with each other to produce, for example, shades of green or black. Furthermore, it is possible, in the context of the invention, to consider colorants for colouring processes which are basically used for colouring cotton, wherein a diaminoazo compound is applied as a colorant using the disperse method, diazotised on the fibre and reacted with a suitable coupling compound to produce trisazo black substances. Furthermore, the invention also covers all variants of so-called finish colouring for disperse colorants.

At the beginning of the invention, the disperse colorants are present in an aqueous liquor. During the colouring procedure they are distributed between the aqueous liquor and the fibre being treated therewith in the same way as between two immiscible or barely miscible liquids and are then absorbed onto the fibres by means of appropriate reaction control procedures and selection of substances.

The fibres are treated in the process according to the invention essentially by placing the fibres and liquor in contact (in an aqueous solution containing the disperse colorants and any auxiliary agents required), for example by immersing the fibres in the liquor and leaving them there for a period. This process is performed, according to the invention, without the addition of carriers and without the application of pressure, i.e. without applying pressures greater than atmospheric pressure, at the boiling point of the liquor or at a temperature below the boiling point of the liquor, in fact so that at least 95% of the colorant present in the liquor is absorbed onto the PTMT fibres. This generally corresponds to a colouring process which exhausts the bath, i.e. the colorant present is completely taken up by the fibres being treated within the scope of the limits of detection.

In an expedient modification of the process according to the invention, a liquor is used for colouring polytrimethylene terephthalate fibres which has between 3.0 and 7.0 g of disperse colorant per kg of PTMT fires being coloured. In a particularly advantageous version of the process, the liquor used contains between 4.5 and 5.5 g of disperse colorant per kg of PTMT fibres. Each of the amounts of disperse colorant mentioned are given with respect to the pure colorant contained in the commercial colorant. Commercial colorants may, as is well known, contain large amounts of auxiliary substances (up to 80 wt. %).

As already specified, the colouring procedure according to the invention is performed without a carrier and without the application of pressure, at the boiling point of the aqueous liquor or at lower temperatures. Depending on the composition of the aqueous liquor, in particular the amount of colorant or auxiliary colouring agent (not a carrier), the boiling point of the liquor may also be above 100° C. However, it has been clearly demonstrated that even at boiling points above 100° C. the colouring process can be performed without the application of pressure, i.e. without the use of a special pressurised vessel, for example in a sealed colouring tank. In general, however, the boiling point of a colouring liquor is only slightly altered by adding the colorant and/or auxiliary agents. In an advantageous embodiment of the invention, the PTMT fibres are therefore treated at a colouring temperature between about 80° and about 110° C. The treatment temperatures are in particular between 90° and 100° C.

In the colouring process according to the invention, an outstandingly uniform distribution of colorant in the fibres is achieved. The colorant penetrates very rapidly in particular into the interior of the fibres. The disperse colorants penetrate to at least a relative depth of 5% into the fibres, with respect to the diameter of the fibres being coloured. The fibres are particularly advantageously completely coloured under the colouring conditions according to the invention, in contrast to polyethylene terephthalate fibres which in comparison are only coloured in an annular manner under identical colouring conditions.

Coloured PTMT fibres obtainable by the colouring process according to the invention can be used in many different ways. Basically, they can be used in all sectors in which known coloured polyester fibres have hitherto also been used. Coloured PTMT fibres obtainable by the process according to the invention are preferably used for the production of woven or knitted fabrics. Due to the exceptional mechanical properties of the coloured PTMT fibres, in particular their high elasticity and ability to recover their shape, use in textiles which are subjected to a high degree of strain or as highly elastic fabrics is also preferred.

BRIEF DESCRIPTION OF THE FIGURES

The invention is explained in more detail in the following by making reference to the enclosed figures by way of examples. The figures show the following.

DESCRIPTION OF THE PREFERRED EMBODIMENTS

PREPARING THE POLYMER

Figure 1:
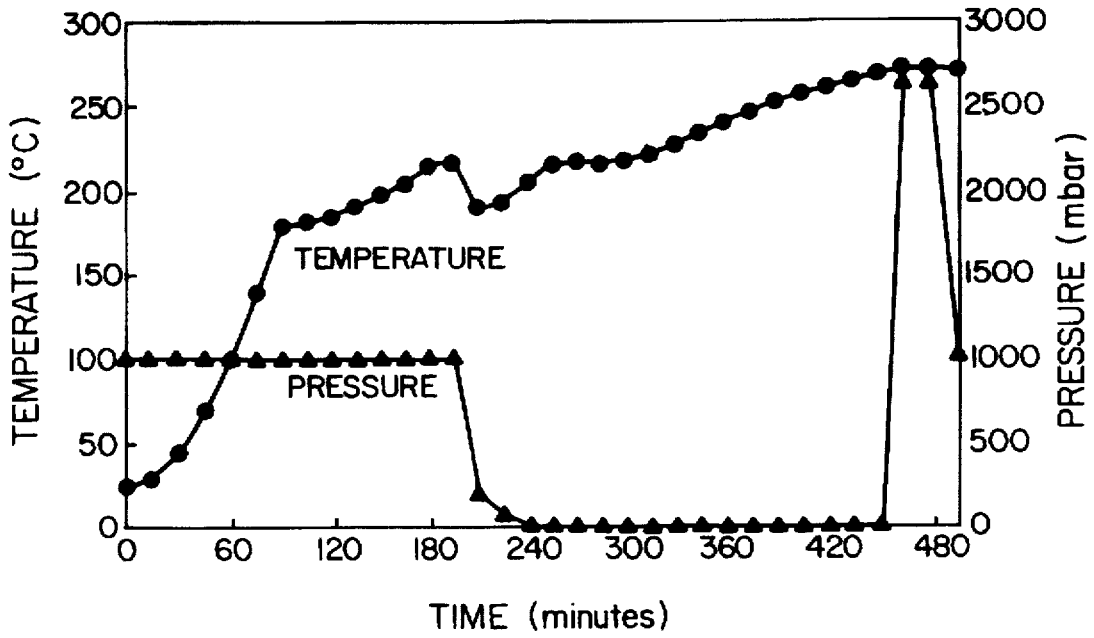
FIG. 1: An example showing the change in temperature and pressure during the synthesis of polytrimethylene terephthalate.

Polytrimethylene terephthalate was prepared in polycondensation plants with 2 or 20 $dm^3$ capacity.

| Batch: | | |
|---|---|---|
| dimethyl terephthalate (fibre grade from Hüls) | 45 mol | 8739 g |
| 1,3-propanediol (Degussa AG) | 10.125 mol | 7705 g |
| titanium tetrabutylate (B. pt. 155° C. at 0.015 torr) | 27 mmol | 9.19 g |
| n-butanol (B. pt. 117° C., water content < 0.01%). | 83.7 | g |

The batch size was 45 moles with respect to the dimethyl terephthalate used, the ratio of 1,3-propanediol (diol batch D with a 1,3-propanediol content of 99.96%, 0.011% of 3-hydroxymethyltetrahydropyrane, 0.005% of 2-hydroxyethyl-1,3-dioxane, 0.02% of carbonyls and 0.04% of water) to dimethyl terephthalate is selected to be 1:2.25 and titanium tetrabutylate is used as a 10 wt. % strength catalyst solution in n-butanol at a concentration of 600 ppm with respect to dimethyl terephthalate.

Transesterification:

Dimethyl terephthalate, 1,3-propanediol and the catalyst solution are placed in the polycondensation apparatus and heated to 140° C. under a continuous gentle stream of nitrogen. After the dimethyl terephthalate has melted, the stirrer is switched on and the temperature raised to 220° C. The methanol released during transesterification is distilled off until the calculated amount has almost been reached.

Polycondensation:

The pressure in the polycondensation apparatus is lowered stepwise and the 1,3-propanediol used in excess and 1,3-propanediol formed during condensation distilled off. The temperature is slowly raised to 270° C. and the pressure is again reduced until finally an oil pump vacuum ($p \leqq 0.05$ bar) is reached. Polycondensation has terminated when the rate of collection of drops of 1,3-propanediol has fallen to less than 0.5 drops per minute. This data applies to the 2 $dm^3$ polycondensation plant. The energy consumed by the stirrer motor was taken as an indirect measure of continuing condensation in the 2 $dm^3$ plant. In the 20 $dm^3$ plant, the torque was taken as a measure of continuing polycondensation. The vacuum in the polycondenstion apparatus was released and the final polytrimethylene terephthalate was discharged into a water bath under an excess pressure of nitrogen using a gear pump, drawn out using a take-off unit and immediately granulated.

Reproducible changes in temperature during synthesis are ensured by means of a computer-controlled temperature programme. The other conditions, such as pressure and stirrer speed are altered manually using a fixed time programme.

The end of polycondensation was determined in preliminary experiments by means of the increase in torque on the stirrer shaft. The torque increases with increasing molecular weight and passes through a maximum which depends on the temperature. After passing through the maximum, the torque drops again because then the degradation reaction proceeds more rapidly than the chain-building reaction. The optimal condensation time for a particular temperature is determined and is then kept constant in subsequent trials.

A temperature drop can be seen at a reaction time of about 210 minutes on FIG. 1. The reason for this is the rapid distillation of large amounts of 1,3-propanediol, wherein more energy is extracted from the reaction mixture than can be supplied to it from outside by the heater.

Furthermore, it is worth noting that the end temperature given for the polycondensation apparatus is 240° C. This temperature is achieved 75 minutes before the end of polycondensation and is then held constant up to the end of polycondensation. However, as can be seen from FIG. 1, the temperature of the melt continuously increases further to 267° C. up to the end of polycondensation. The heat required for this is not supplied from outside by the heater, but is produced by the stirred heat in the apparatus itself. That this effect only occurs towards the end of polycondensation is explained by the constantly increasing viscosity of the polycondensation melt.

A set of polymers are produced in the way described. The most important properties of the polymers used in the subsequent spinning tests are given in Table 1.

TABLE 1

| Polymer batch | Mw (g/mol) | COOH [mg equ./kg] | L* | a* | b* |
|---|---|---|---|---|---|
| A) PTMT 20/14 | 49700 | 34 | 69 | −1.8 | +6.7 |
| PTMT 20/11 | 50400 | 35 | 69 | −1.6 | +7.4 |
| PTMT 20/13 | 51000 | 27 | 70 | −1.5 | +5.8 |
| B) PTMT 20/12 | 53100 | 29 | 70 | −1.7 | +6.2 |
| PTMT 20/18 | 55200 | 24 | 69 | −1.7 | +5.7 |
| PTMT 20/19 | 55900 | 26 | 69 | −1.6 | +5.9 |
| C) PTMT 20/15 | 57300 | 26 | 70 | −1.8 | +6.4 |
| PTMT 20/16 | 59400 | 25 | 70 | −1.7 | +5.6 |
| PTMT 20/17 | 60100 | 25 | 69 | −1.7 | +5.3 |
| PET Rhodia | | | | | |
| Standard: Mn = 20500 | | 34 | matted granulate | | |

The analytical data in Table 1 were obtained as follows:

Molecular weight (Mw (g/mol)):

The weight average of the molecular weight is determined using static light scattering. For this, polymer solutions with the concentrations 2, 4, 6, 8 and 10 g/l are prepared in 1,1,1,3,3,3-hexafluoroisopropanol. The filtered solutions at 20° C. are placed in the beam path of a helium laser (λ=633 nm) and the variation in intensity of the scattered light with angle of observation is determined. Toluene is used as a standard for determining the optical constants and for controlling the temperature of the samples. The scattered light intensities are plotted against angle and concentration on a Zimm plot.

An instrument from the Société française d'instruments de contrôle et d'analyses: Photogonio/scatterometer from Wippler & Scheibling was used.

The refractive index was determined using a Wyatt Opilab 903 Interferometric Refractomer from Wyatt Technology Corporation.

Terminal carboxyl groups (COOH[mg equ./kg]):

The terminal carboxyl groups are determined by dissolving 4 g of polymer at 80° C. in 70 ml of a solvent mixture consisting of phenol/chloroform=1:1 (g/g). After cooling to room temperature, 5 ml of benzyl alcohol and 1 ml of water are added and the solution is conductometrically titrated with 0.02N potassium hydroxide solution in benzyl alcohol. The potassium hydroxide solution is added continuously using a Dosimat 665 from Methrom and the conductivity is followed using a DIGI 610 from WTW to which a conductivity measuring cell is attached (cell constant: 0.572).

Colour measurement (L*, a* and b*):

The ability of the polymers to be coloured is quoted using CIELAB colour values. The polymer granules are measured with a Minolta CR 310, whose sectral (sic) sensitivity is closely adjusted to the CIE 2° standard observer function. The measuring field diameter is 5 cm and calibration makes use of a white standard.

PRODUCING THE FIBRES

Drying

The polymers are dried before the spinning trials in batches of about 25 kg each in a tumble dryer with a capacity of 100 $dm^3$ from Henkhaus Apparatebau. Polymer batches PTMT 20/14+PTMT 20/11+PTMT 20/13, PTMT 20/12+PTMT 20/18+PTMT 20/19 and PTMT 20/15+PTMT 20/16+PTMT 20/17 were mixed in order to obtain mixed batches A), B) and C) (see Table 1).

Table 2 gives the drying conditions:

TABLE 2

| | | |
|---|---|---|
| 1 hour | 80° C. [130° C.] | p < 0.2 mbar |
| 1 hour | 100° C. [130° C.] | p < 0.2 mbar |
| 10 hours | 165° C. [180° C.] | p < 0.2 mbar |

The temperatures given in square brackets refer to the drying of polyethylene terephthalate, which was processed to give fibres under similar conditions to those used for polytrimethylene terephthalate.

Finally the tumble dryer was cooled to room temperature while nitrogen was introduced over the course of 12 hours.

The water content of the dried polymers was less than 0.0025% so that a significant degree of polymer degradation during the melt spinning process is excluded.

Melt spinning:

A spinning unit described in T. C. Barth "Struktur und Eigenschaften von Fasern aus Polyethylen-/polybutylenterephthalat-Mischungen hergestellt im Schnellspinnverfahren", Dissertation, 1989, Univ. Stuttgart, is used for the spinning trials.

Spinning Unit:

Extrusion screw: 30 mm; 25 D

Spinning nozzles: 32×0.20 mm (32×0.35 mm)

Spinning pump: 2.4 $cm^3$/rev

Spinning temperature 250° C. [290° C.]

Reeling speed: 2000 to 5000 m/min

An aqueous emulsion made from 10% Limanol PVK and 1.6% Ukanol R is used as a preparation. The preparation is applied at a rate of about 0.5%.

To prepare specific spinning titres, the density of the polymer melt must be known. Accordingly, the following applies to a specific application of preparation:

Polytrimethylene terephthalate: ρ 250° C.=1.09 g/cm$^3$

Polyethylene terephthalate: ρ 290° C.=1.29 g/cm$^3$

Preparation solution: ρ 20° C.=0.923 g/cm$^3$

During the spinning trials, commercially available polyethylene terephthalate was spun as well as polytrimethylene terephthalate. The spinning speeds are varied in the range 2000 to 5000 m/min for a spinning titre of 16 tex for 32 individual filaments. The spinning titre is varied in the range 9.6 to 22.4 tex for 32 individual filaments each time at a constant spinning speed of 3500 m/min. This corresponds to a fineness of 0.3 to 0.7 tex per individual filament.

In the case of polytrimethylene terephthalate, the spinning temperature is varied between 240° and 270° C., wherein the best results are produced at 250° C. In addition, different spinning nozzles with nozzle orifice diameters of 200 to 350 μm are used for polytrimethylene terephthalate. The best results are produced with a 200 μm nozzle.

The spun fibres obtained are stretched on a stretching system from Diens Apparatebau. The stretching factors are selected so that the stretched fibres have an extension of about 25%.

The mechanical properties of the spun fibres and the stretched fibres made from polytrimethylene and polyethylene terephthalate are listed in the following:

Polytrimethylene terephthalate spun fibres:

| Spinning speed [m/min] | Spinning titre [tex] | Maximum tensile force [CN/dtex] | Initial modulus [CN/dtex] | Extension % |
|---|---|---|---|---|
| 2000 | 15.9 | 1.68 | 19.9 | 139 |
| 2500 | 16.1 | 1.97 | 20.8 | 107 |
| 3000 | 16.1 | 2.25 | 22.0 | 85 |
| 3500 | 16.1 | 2.48 | 23.2 | 68 |
| 4000 | 16.3 | 2.59 | 23.6 | 60 |
| 4500 | 16.3 | 2.53 | 23.3 | 59 |
| 5000 | 15.8 | 2.59 | 22.9 | 55 |
| 3500 | 9.6 | 2.54 | 23.2 | 68 |
| 3500 | 12.9 | 2.49 | 23.0 | 68 |
| 3500 | 16.1 | 2.48 | 23.2 | 68 |
| 3500 | 19.4 | 2.44 | 22.7 | 67 |
| 3500 | 22.7 | 2.34 | 22.4 | 64 |

Stretched polytrimethylene terephthalate fibres

| Spinning speed [m/min] | Stretch factor | Stretch titre [tex] | Maximum tensile force [CN/dtex] | Modulus [CN/dtex] | Extension % |
|---|---|---|---|---|---|
| 2000 | 1.78 | 9.0 | 2.76 | 24.1 | 42 |
| 2000 | 1.90 | 8.8 | 2.92 | 24.3 | 38 |
| 2000 | 2.00 | 8.4 | 2.97 | 24.8 | 32 |
| 2000 | 2.11 | 7.9 | 3.20 | 26.2 | 26 |
| 2000 | 2.20 | 7.9 | 3.34 | 24.6 | 24 |
| 2000 | 2.32 | 7.2 | 3.75 | 26.8 | 22 |
| 2000 | 2.41 | 7.1 | 3.98 | 27.1 | 20 |
| 2000 | 2.16 | 7.9 | 3.26 | 24.7 | 26 |
| 2500 | 1.87 | 9.2 | 3.43 | 25.1 | 26 |
| 3000 | 1.66 | 10.4 | 3.52 | 25.3 | 24 |
| 3500 | 1.44 | 12.1 | 3.29 | 25.5 | 25 |
| 4000 | 1.37 | 12.8 | 3.38 | 25.4 | 26 |
| 4500 | 1.36 | 12.8 | 3.34 | 25.1 | 25 |
| 5000 | 1.35 | 13.1 | 3.35 | 25.4 | 27 |
| 3500 | 1.44 | 7.1 | 3.49 | 25.8 | 24 |

-continued

| Spinning speed [m/min] | Stretch factor | Stretch titre [tex] | Maximum tensile force [CN/dtex] | Modulus [CN/dtex] | Extension % |
|---|---|---|---|---|---|
| 3500 | 1.44 | 9.6 | 3.41 | 25.8 | 25 |
| 3500 | 1.44 | 12.1 | 3.29 | 25.5 | 25 |
| 3500 | 1.44 | 14.5 | 3.29 | 26.0 | 24 |
| 3500 | 1.44 | 16.8 | 3.24 | 24.4 | 22 |

Polyethylene terephthalate spun fibres:

| Spinning speed [m/min] | Spinning titre [tex] | Maximum tensile force [CN/dtex] | Initial modulus [CN/dtex] | Extension % |
|---|---|---|---|---|
| 2000 | 15.8 | 1.82 | 21.3 | 156 |
| 2500 | 15.8 | 2.07 | 23.5 | 131 |
| 3000 | 15.3 | 2.29 | 27.1 | 110 |
| 3500 | 15.9 | 2.55 | 33.3 | 93 |
| 4000 | 15.9 | 2.67 | 41.2 | 79 |
| 4500 | 15.6 | 2.86 | 51.4 | 68 |
| 5000 | 14.8 | 3.21 | 60.2 | 60 |
| 3500 | 9.6 | 2.63 | 40.6 | 89 |
| 3500 | 12.8 | 2.56 | 37.2 | 90 |
| 3500 | 15.9 | 2.55 | 33.3 | 93 |
| 3500 | 19.0 | 2.54 | 32.9 | 93 |
| 3500 | 22.2 | 2.46 | 31.4 | 93 |

Stretched polyethylene terephthalate fibres:

| Spinning speed [m/min] | Stretch factor | Stretch titre [tex] | Maximum tensile force [CN/dtex] | Modulus [CN/dtex] | Extension % |
|---|---|---|---|---|---|
| 2000 | 1.79 | 8.9 | 3.45 | 68.1 | 43 |
| 2000 | 1.88 | 8.5 | 3.75 | 76.7 | 38 |
| 2000 | 1.98 | 8.1 | 3.93 | 82.8 | 31 |
| 2000 | 2.08 | 7.8 | 4.01 | 91.5 | 24 |
| 2000 | 2.20 | 7.4 | 4.26 | 104.0 | 17 |
| 2000 | 2.29 | 7.1 | 4.50 | 108.7 | 9 |
| 2000 | 2.42 | 6.8 | 5.25 | 117.2 | 6 |
| 2000 | 2.07 | 7.8 | 4.10 | 97.5 | 24 |
| 2500 | 1.85 | 8.7 | 4.08 | 100.2 | 25 |
| 3000 | 1.69 | 9.2 | 4.20 | 103.0 | 24 |
| 3500 | 1.55 | 10.5 | 4.21 | 103.3 | 26 |
| 4000 | 1.46 | 11.1 | 4.19 | 106.8 | 26 |
| 4500 | 1.38 | 11.6 | 4.06 | 105.1 | 25 |
| 5000 | 1.31 | 11.5 | 4.34 | 112.6 | 25 |
| 3500 | 1.55 | 6.4 | 4.26 | 110.5 | 24 |
| 3500 | 1.55 | 8.4 | 4.31 | 108.0 | 25 |
| 3500 | 1.55 | 10.5 | 4.21 | 103.3 | 26 |
| 3500 | 1.55 | 12.6 | 4.17 | 102.3 | 25 |
| 3500 | 1.55 | 14.6 | 4.15 | 101.8 | 25 |

COLOURING TESTS

The glass transition temperature of the polymers in aqueous medium is of great importance for the colouring behaviour of synthetic fibres. D. R. Buchanan and J. P. Walters, Text. Res. J. 47 (1977), 398, define a colouring transition temperature. For this the absorption of colorant by the synthetic fibres is determined as a function of temperature. The temperature at which the absorption of colorant reaches 50% of the equilibrium value is defined as the colouring transition temperature. The colouring transition temperature also depends, however, on the time of colouring and the structure of the colorant.

Substrates:

The use of fibre flocks in colouring trials has the disadvantage that the fibres can become knotted and then can no longer be uniformly surrounded by the colouring liquor. The unequal degrees of colouring thereby obtained cannot be used to determine the colorant content. The colouring trials are therefore performed using knitted fabrics made from stretched fibres. To produce the knitted fabrics to give a knitted hose (diameter 10 cm), an Elba model circular knitting machine from Machinenfabrik Lucas was used.

Knitted fabrics made from the following fibres were used in the colouring trials:

| Polymer | spinning speed [m/min] | Spinning titre [tex] | Stretch factor | Stretch titre [tex] |
|---|---|---|---|---|
| PTMT | 3500 | 16.1 | 1.44 | 12.1 |
| PET | 3500 | 19.0 | 1.55 | 126 |

In order for the stretch titre and thus the fibre diameter of the fibres being coloured to be comparable, a higher spinning titre was selected due to the different stretch factors of polyethylene terephthalate.

The fibres are washed after being knitted on the circular knitting machine in order to remove the preparation applied during spinning.

Pretreatment:

To remove the spinning preparation, the knitted fabric is washed as follows:

Washing conditions:

Apparatus: Mathis LAB Jumbo Jet with washing drum
Temperature: 30° C.
Duration: 120 min
Washing liquor: 1 g/l of Kieralon® EDB from Bayer AG
Liquor ratio: 1:50

To avoid shrinking during colouring and to improve the dimensional stability of the knitted fabrics, these are thermofixed at 180° C. for one minute. This relaxes the stresses in the fibres produced during stretching. The thermofixed knitted fabrics made from polytrimethylene terephthalate exhibit a higher degree of area shrinkage than those made from polyethylene terephthalate.

Fixing conditions:

Apparatus: Mathis dryer
Temperature: 180° C.
Duration: 1 min

Colorant:

Two disperse colorants were selected which clearly differed with regard to their coefficients of diffusion:

| Colorant | Coefficient of diffusion [$10^{10}$ cm$^{-2}$.s] | |
|---|---|---|
| C.I. Disperse Blue 139 | 0.8 | mono-azo colorant resolin marine blue GLS from Bayer AG |
| C.I. Disperse Red 60 | 3.4 | anthraquinone colorant resolin red FB from Bayer AG |

The extinction coefficient of the pure colorant must be known for quantitative determination of the absorption of colorant. Purification of the disperse colorants mentioned above is described in detail in E. M. Schnaith (Dissertation 1979, Univ. of Stuttgart).

The colouring temperatures are varied in the range between 60° C. and 140° C.

Colouring is always started at 40° C. and the rate of heating is selected so that the colouring temperature is reached after 45 minutes. The rate of cooling is always 1 K/min until the bath reaches a temperature of 40° C.

Colouring conditions:

Colouring equipment: Ahiba Polymat
Colouring time: 60 min
Liquor ratio: 1:20
Liquor: 1 g/l of colorant 2 g/l of Avolan®IS from Bayer AG 2 g/l of sodium dihydrogen phosphate dihydrate Reductive after-treatment:

To remove colorant which has been deposited on the surface of the fibres, the colouring procedure is followed by a reductive after-treatment. The rate of heating the reduction liquor is 2 K/min, the rate of cooling is 1 K/min.

Reduction conditions:

Equipment: Ahiba Polymat
Temperature: 70° C.
Liquor ratio: 1:20
Liquor 3 g/l of sodium dithionite 1.2 g/l of sodium hydroxide 1 g/l of Levegal® HTN from Bayer AG Finally, the knitted fabric is acidified with 5% strength formic acid.

Absorption of colorant:

To determine the absorption of colorant, the fibres coloured at different temperatures are exhaustively extracted with chlorobenzene. The extracts are diluted to a specific volume and the extinctions of the solution are determined using a UV/VIS spectrophotometer of the type Lambda 7 from the Perkin Elmer Bodensee works. The colorant content can be determined from the extinction of the extraction solution at the characteristic wavelengths C.I. Disperse Blue 139: 604 nm and
C.I. Disperse Red 60: 516 nm, by using the corresponding calibration lines.

Determining the colorant content CC in g/kg of goods is performed using the numerical equations:

C.I. Disperse Blue 139:

$$CC\ [g/kg\ of\ goods] = \frac{E + 3.2 \times 10^{-3}}{0.05948} \times \frac{\text{volume of extraction solution [ml]}}{\text{weight of extracted sample [mg]}}$$

C.I. Disperse Red 60:

$$CC\ [g/kg\ of\ goods] = \frac{E + 4.67 \times 10^{-4}}{0.04115} \times \frac{\text{volume of extraction solution [ml]}}{\text{weight of extracted sample [mg]}}$$

Figure 2:
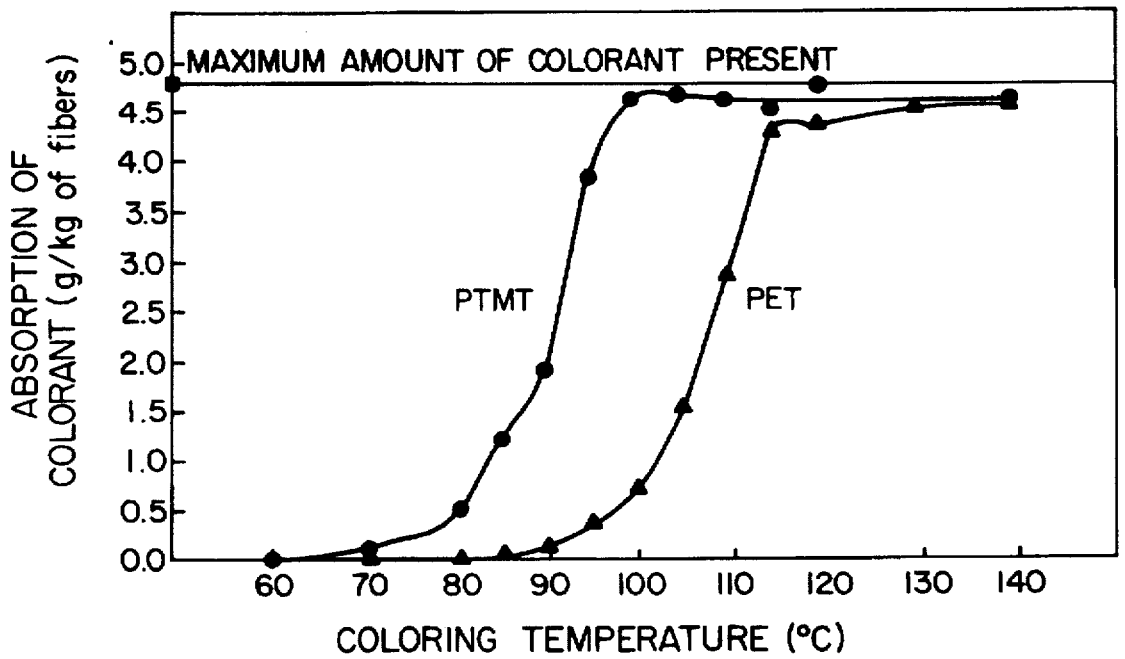
FIG. 2: For colorant C.I. Disperse Blue 139, the variation in absorption of colorant with colouring temperature for polytrimethylene and polyethylene terephthalate fibres.
Figure 3:
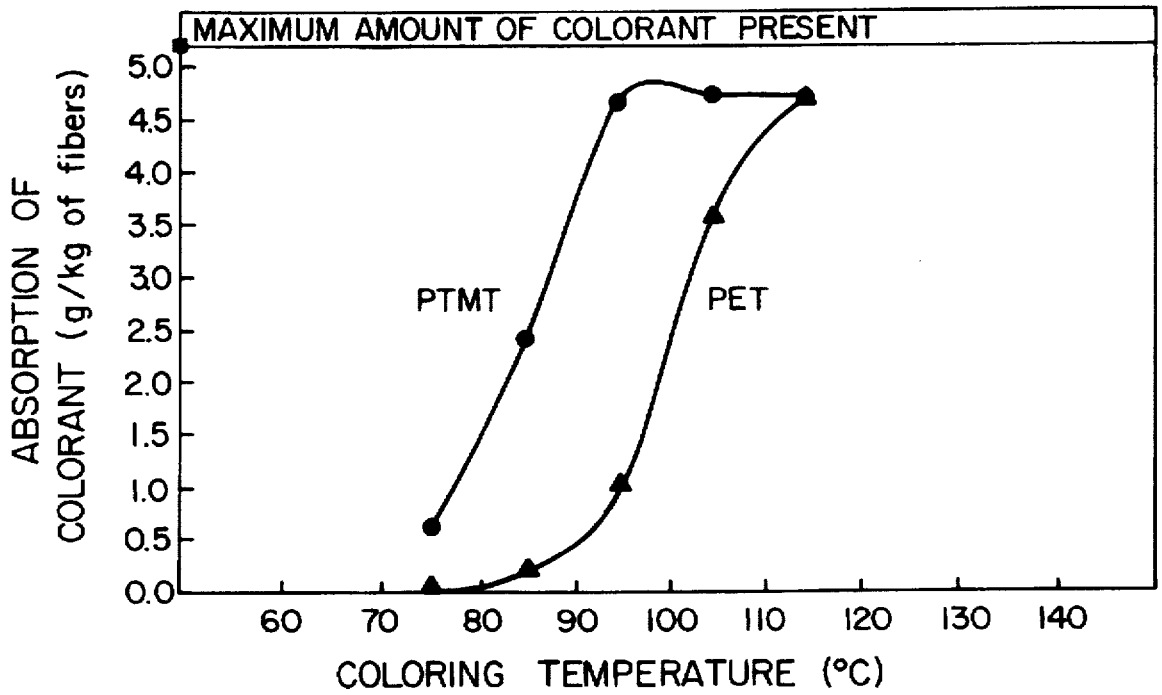
FIG. 3: For colorant C.I. Disperse Red 60, the variation in absorption of colorant with colouring temperature for polytrimethylene and polyethylene terephthalate fibres.

FIGS. 2 and 3 show the absorption of colorant by polytrimethylene terephthalate fibres as a function of the colouring temperature as compared with that of polyethylene terephthalate fibres.

In FIGS. 2 and 3, the horizontal line indicates the amount of colorant present in the colouring liquor with respect to the amount of substrate used.

It can be seen from FIG. 2 that colouring of polytrimethylene terephthalate fibres starts at about 70° C., whereas polyethylene terephthalate fibres are only definitely coloured at temperatures above 90° C.

The maximum determinable absorption of colorant is about 95% of the maximum possible absorption of colorant because the fibre samples are reductively after-treated before extraction. This reductively destroys the colorant adhering to the surface of the fibres and therefore lowers the maximum determinable colorant content.

Furthermore, FIG. 2 shows that the total colorant is absorbed from the colouring liquor onto polytrimethylene terephthalate fibres at a colouring temperature of 100° C. On the other hand, at a colouring temperature of 100° C., only about 15% of the colorant present is absorbed onto the polyethylene terephthalate fibres.

For the colorant present to be completely absorbed onto polyethylene terephthalate fibres, the colouring temperature has to be raised to 130° C. This means that bath-exhaustive colouring of polyethylene terephthalate fibres has to be performed in sealed containers under pressure (HT colouring conditions).

In the case of C.I. Disperse Red 60, a disperse colorant with a higher coefficient of diffusion, an almost identical plot of absorption of colorant against colouring temperature is observed as with C.I. Disperse Blue 139.

The trace of the curve, however, in the case of C.I. Disperse Red 60 is shifted by about 5 to 10K to lower temperatures than with C.I. Disperse Blue 139. This behaviour is explained by the higher coefficient of diffusion of C.I. Disperse Red 60, because the colorant molecules can diffuse into the interior of the fibres more rapidly.

Colouring with C.I. Disperse Red 60 shows a maximum absorption of colorant by polytrimethylene terephthalate fibres as from a colouring temperature of 95° C.

With polyethylene terephthalate fibres, the maximum absorption of colorant is only achieved at a colouring temperature of 120° C., so that here again bath-exhaustive colouring has to be performed in sealed equipment under pressure.

The colouring transition temperatures of polytrimethylene terephthalate and polyethylene terephthalate are therefore:

| | PTMT | PET |
|---|---|---|
| C.I. Disperse Blue 139 | 91° C. | 107° C. |
| C.I. Disperse Red 60 | 84° C. | 100° C. |

The colouring transition temperature when colouring with C.I. Disperse Red 60 is about 7K lower than when colouring with C.I. Disperse Blue 139 due to its higher coefficient of diffusion. The difference of 16K in the colouring transition temperatures of the two polymers, however, remains constant.

Figure 4:
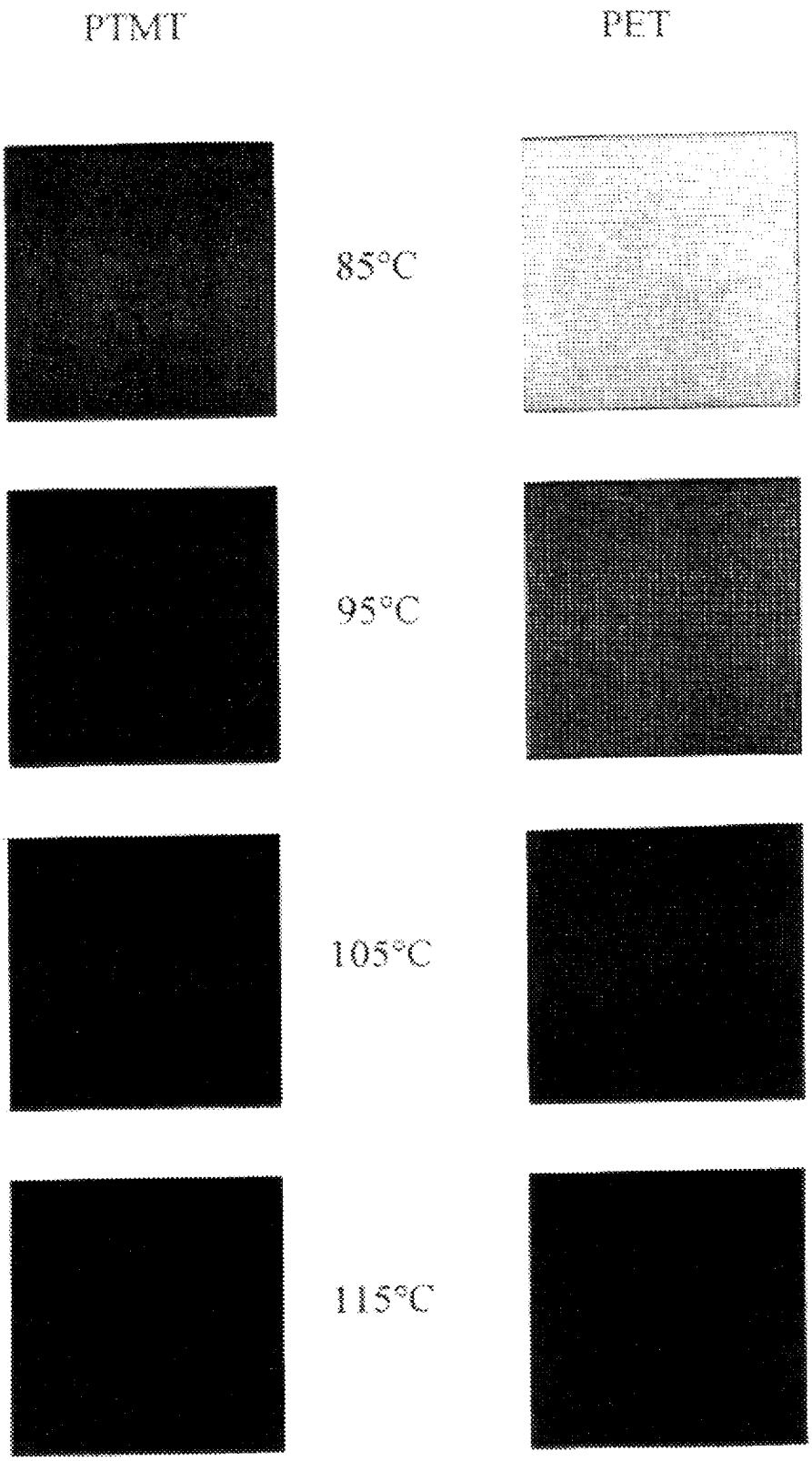
FIG. 4: Coloured samples of PTMT and PET fibre polymers for the same colouring time using C.I. Disperse Blue 139 as a function of the colouring temperature, represented by shades of grey.
Figure 5:
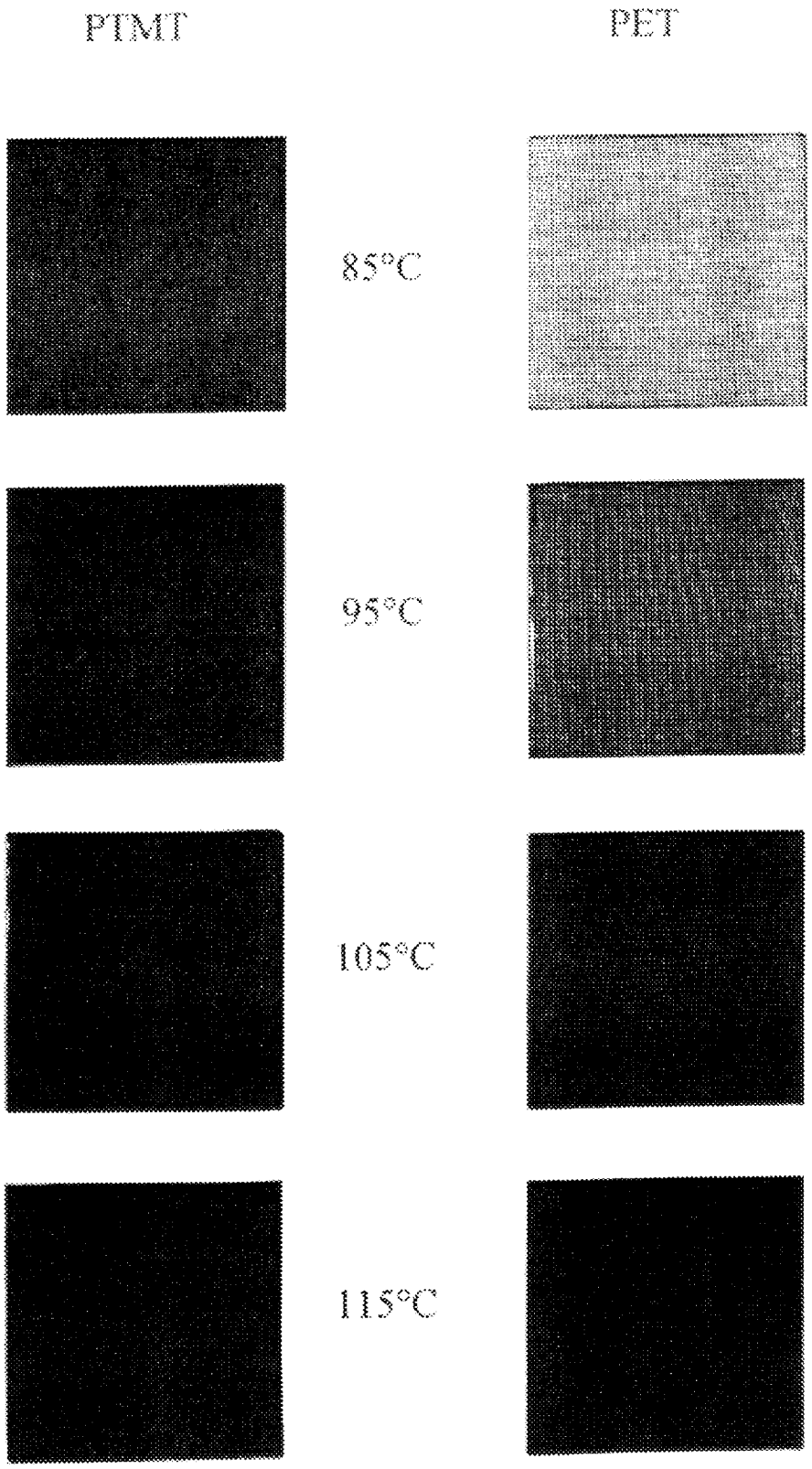
FIG. 5: Coloured samples of PTMT and PET fibre polymers for the same colouring time using C.I. Disperse Red 60 as a function of the colouring temperature, represented by shades of grey.

FIGS. 4 and 5 show coloured samples of the two fibre polymers for the same colouring time as a function of colouring temperature. This best demonstrates the difference in absorption of colorant. The colour intensity differences are represented by shades of grey.

Distribution of colorant:

Distribution of the colorant in the fibres can be assessed using cross-sections of the fibres. Complete colouring and annular colouring can be differentiated. Cross-sections of fibres are obtained by embedding the fibres in an acrylate and cutting them in slices 10 μm thick with a Minot-Mikrotom from the Jung Co. The cross-sectional absorptions are photographed using a Zeiss Axioplan microscope. The fastness of a colour when shear strain is placed on the coloured flat structure is higher in the case of complete colouring than with annular colouring, when the colorant is only incorporated into the external layer of the fibre.

The cross-sections investigated were coloured with C.I. Disperse Blue 139 because this colorant has a very low coefficient of diffusion. When using other colorants with higher coefficients of diffusion, complete colouring would be expected even at low colouring temperatures.

Figure 6A:
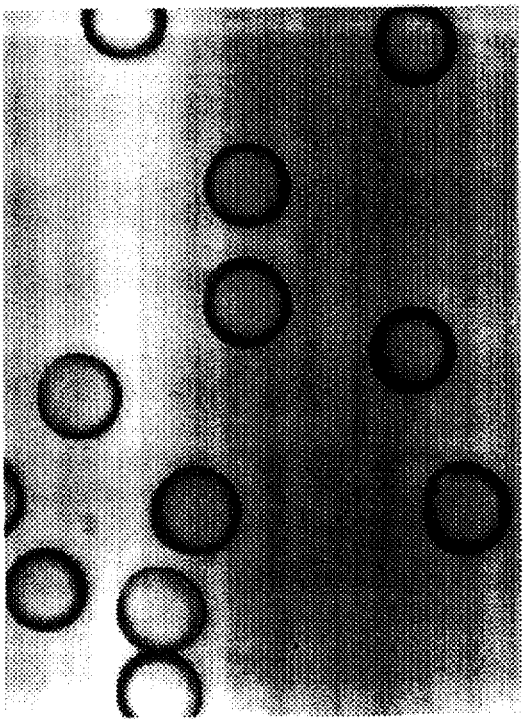
FIG. 6: Cross-section of fibres which have been coloured at 95° C. with C.I. Disperse Blue 139; polytrimethylene terephthalate (left-hand side) and polyethylene terephthalate (right-hand side).
Figure 6B:
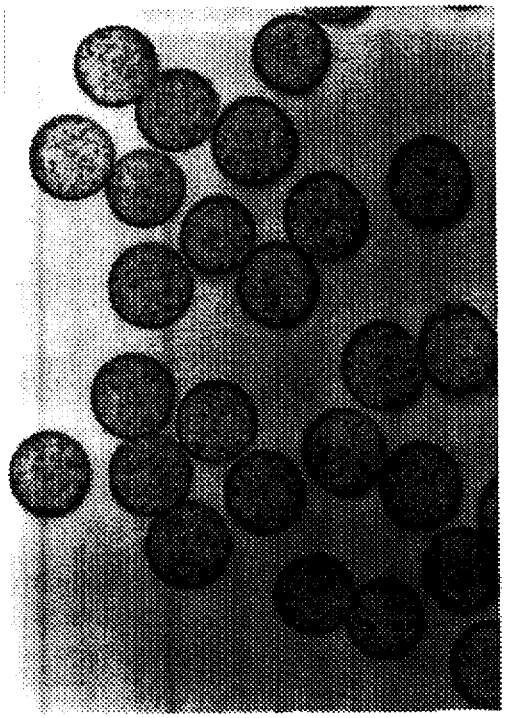
Figure 7A:
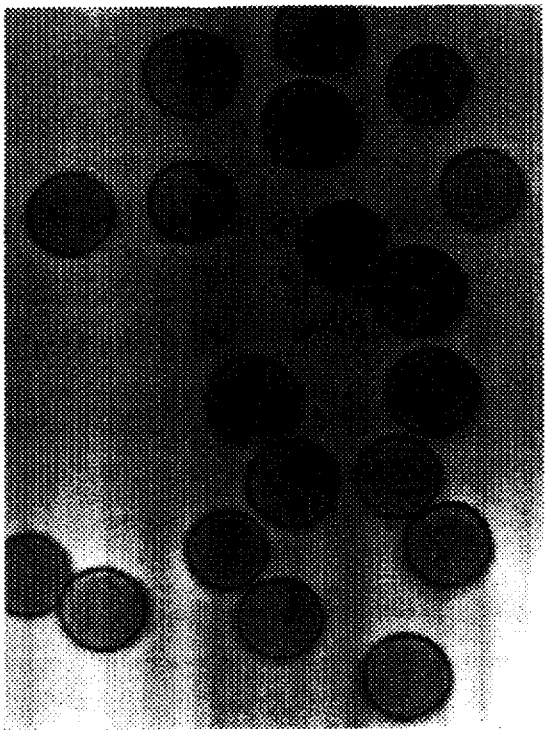
FIG. 7: Cross-section of fibres which have been coloured at 120° C. with C.I. Disperse Blue 139; polytrimethylene terephthalate (left-hand side) and polyethylene terephthalate (right-hand side).
Figure 7B:
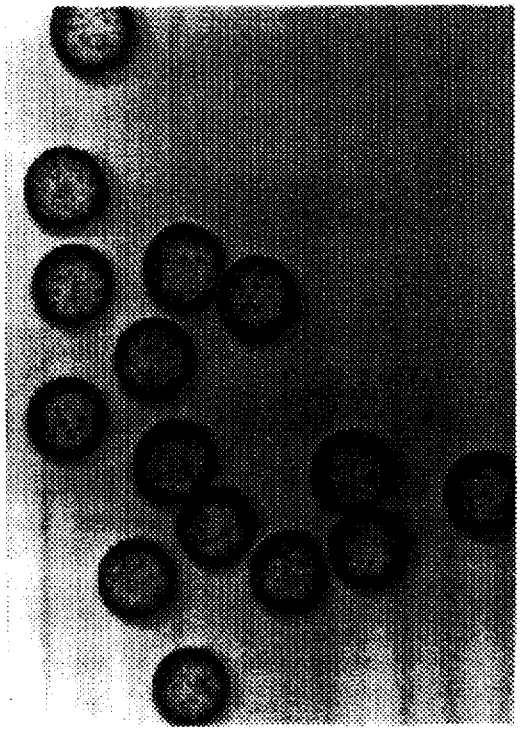

FIGS. 6 and 7 show cross-sections of polytrimethylene and polyethylene terephthalate fibres which have been coloured at 95° C. and 120° C. with C.I. Disperse Blue 139.

In the case of the polyethylene terephthalate fibres, the titanium dioxide particles with which the polymer granules used have been matted can be seen.

The cross-sections of the fibres show that the colorant penetrates into the interior of polytrimethylene terephthalate fibres more rapidly than is the case with polyethylene terephthalate fibres.

Figure 8:
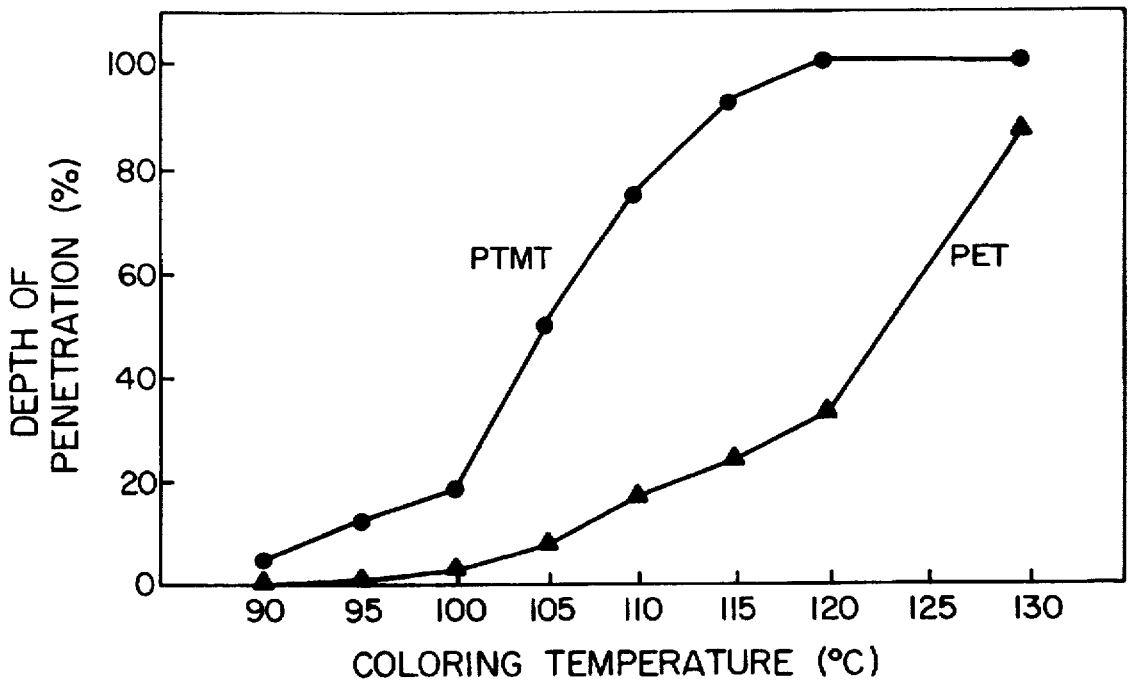
FIG. 8: Variation in the depth of penetration of colorant C.I. Disperse Blue 139 with colouring temperature for polytrimethylene and polyethylene terephthalate.

FIG. 8 shows the depth of penetration with respect to the diameter of the fibres as a function of colouring temperature.

If FIG. 8 is compared with FIG. 2, then the following observations may be made:

Polytrimethylene terephthalate fibres can be outstandingly coloured with C.I. Disperse Blue 139 at boiling point. The fibres absorb the entire amount of the colorant present in the colouring liquor. The concentration of colorant is greatest in the edge areas. During HT colouring, the diffusion of colorant is accelerated so that uniform complete colouring can be observed over the whole cross-section of the fibres.

In contrast, the absorption of colorant by polyethylene terephthalate fibres is much lower at the boiling point. The absorption of colorant by the fibres is only 10% of the colorant present in the colouring liquor. Under HT conditions, polyethylene terephthalate fibres can also be effectively coloured. The entire amount of colorant penetrates into the fibres, but complete colouring of the fibres is not observed with C.I. Disperse Blue 139.

Further advantages and embodiments of the invention may be found in the following patent claims.

We claim:

1. A process for colouring polytrimethylene terephthalate fibres, in which the fibres are treated in an aqueous liquor containing at least one disperse colorant, in the absence of a carrier and application of pressure, wherein colouring begins when the liquor temperature is between 20° and 50° C., the temperature then being raised over a period of between 20 and 90 minutes, to a maximum temperature of between about 80° and 110° C., which temperature is maintained for at least 20 minutes, the temperature then being lowered to 20° to 50° C., so that at least 95 wt. % of the colorant present in the liquor is absorbed by the fibres and the disperse colorant penetrates the fibres to a relative depth of at least 5% with respect to the diameter of the fibres being coloured.

2. A process according to claim 1 wherein a liquor is used which contains between 3.0 and 7.0 g of pure disperse colorant per kg of PTMT fires being coloured.

3. A process according to claim 2, wherein a liquor with a disperse colorant content of 4.5 to 5.5 g of pure disperse colorant per kg of PTMT fibres is used.

4. A process according to claim 1, wherein the colouring temperature is between 90° and 100° C.

5. A process according to claim 1, wherein the colouring temperature is between 90° and 100° C.

6. A process according to claim 1, wherein the colouring temperature is between 90° and 100° C.

7. A process according to claim 1, wherein the fibres are completely coloured.

8. A process according to claim 2, wherein the fibres are completely coloured.

9. A process according to claim 3, wherein the fibres are completely coloured.

10. A process according to claim 4, wherein the fibres are completely coloured.

11. A process according to claim 5, wherein the fibres are completely coloured.

12. A process according to claim 6, wherein the fibres are completely coloured.

13. A process according to claim 1, wherein the liquor temperature is raised over 45 minutes.

14. A process according to claim 1, wherein colouring is continued for 30–90 minutes.

15. A process according to claim 1, wherein the liquor temperature is lowered at a cooling rate of 1° C. per minute.

16. A process according to claim 13, wherein colouring is continued for 30–90 minutes.

17. A process according to claim 13, wherein the liquor temperature is lowered at a cooling rate of 1° C. per minute.

18. A process according to claim 14, wherein the liquor temperature is lowered at a cooling rate of 1° C. per minute.

19. A process according to claim 1 wherein the liquor temperature is raised over 45 minutes, the colouring is continued for 30–60 minutes, and the liquor temperature is lowered at a cooling rate of 1° C. per minute.

* * * * *